US008807516B2

(12) United States Patent
Guo et al.

(10) Patent No.: US 8,807,516 B2
(45) Date of Patent: Aug. 19, 2014

(54) BLOWOUT PREVENTER WITH ROPE PACKING SEAL

(75) Inventors: Tianle Guo, Edmonton (CA); Tony M. Lam, Edmonton (CA)

(73) Assignee: Stream-Flo Industries Ltd., Edmonton (CA)

( * ) Notice: Subject to any disclaimer, the term of this patent is extended or adjusted under 35 U.S.C. 154(b) by 147 days.

(21) Appl. No.: 12/967,421

(22) Filed: Dec. 14, 2010

(65) Prior Publication Data

US 2011/0140013 A1 Jun. 16, 2011

Related U.S. Application Data

(60) Provisional application No. 61/286,508, filed on Dec. 15, 2009.

(51) Int. Cl.
*E21B 33/06* (2006.01)

(52) U.S. Cl.
USPC ..... 251/1.3; 166/85.4; 277/494; 277/496

(58) Field of Classification Search
USPC ..... 251/1.1, 1.3; 166/85.4, 364; 277/494, 277/496–498, 458
See application file for complete search history.

(56) References Cited

U.S. PATENT DOCUMENTS 1,767,164 A * 6/1930 Ahern et al. ..... 277/445
1,886,340 A * 11/1932 King ..... 251/1.3
2,194,259 A 3/1940 Allen
2,639,198 A 5/1953 Kirkham
2,746,710 A 5/1956 Jones
3,720,140 A 3/1973 Lee
3,762,729 A 10/1973 Hopp
4,428,592 A 1/1984 Shaffer
4,508,312 A 4/1985 Taylor et al.
4,518,144 A 5/1985 Vivic et al.
4,553,730 A 11/1985 Vivic
4,699,350 A * 10/1987 Herve ..... 251/1.3
4,986,511 A 1/1991 Irby et al.
5,044,602 A 9/1991 Heinonen
5,044,603 A 9/1991 Granger et al.
5,125,620 A 6/1992 Young
5,180,137 A 1/1993 Carlson et al.
5,294,088 A 3/1994 McWhorter et al.
5,713,581 A 2/1998 Carlson et al.
5,743,332 A 4/1998 Lam et al.
5,765,813 A 6/1998 Lam et al.
5,944,110 A 8/1999 Watts et al.
6,176,466 B1 1/2001 Lam et al.

(Continued)

FOREIGN PATENT DOCUMENTS

CA 2260655 8/2000

*Primary Examiner* — John K Fristoe, Jr.
*Assistant Examiner* — Reinaldo Sanchez-Mendina
(74) *Attorney, Agent, or Firm* — Lathrop & Gage LLP

(57) ABSTRACT

A blowout preventer (BOP) is provided in which each ram includes a primary rope packing seal formed from a first length of rope packing extending horizontally across the front face, rearwardly and then either or both of upwardly and downwardly over the top and/or bottom portion of the ram. The primary rope packing seal is held in, so as to protrude radially outwardly from, a continuous first groove formed in the ram. The continuous first groove is adapted to accommodate joined abutting ends or overlapping ends of the first length of rope packing. A secondary rope packing seal and a circumferential rope packing seal may be provided on the ram.

39 Claims, 10 Drawing Sheets

(56) References Cited

U.S. PATENT DOCUMENTS

| | | | | |
|---|---|---|---|---|
| 6,367,804 | B1 | 4/2002 | Watts | |
| 6,394,460 | B1 | 5/2002 | Leggett et al. | |
| 6,457,530 | B1 | 10/2002 | Lam et al. | |
| 6,595,278 | B1 | 7/2003 | Lam et al. | |
| 6,719,262 | B2 | 4/2004 | Whitby | |
| 6,877,712 | B2 | 4/2005 | Wiedemann | |
| 7,010,844 | B2 | 3/2006 | Pekarsky | |
| 7,137,610 | B2 | 11/2006 | Lam | |
| 7,552,765 | B2 | 6/2009 | Lam | |
| 7,673,674 | B2 | 3/2010 | Lam | |
| 7,703,739 | B2 | 4/2010 | Judge et al. | |
| 7,717,433 | B2 | 5/2010 | Taylor et al. | |
| 2006/0038147 | A1* | 2/2006 | Urrutia | 251/1.3 |
| 2007/0175625 | A1* | 8/2007 | Lam | 166/85.1 |
| 2007/0175626 | A1* | 8/2007 | Lam | 166/85.4 |

* cited by examiner

BLOWOUT PREVENTER WITH ROPE PACKING SEAL

CROSS-REFERENCE TO RELATED APPLICATIONS

This application claims priority from U.S. Provisional Patent Application No. 61/286,508 filed Dec. 15, 2009, which is incorporated by reference in its entirety to the extent that there is no inconsistency with the present disclosure.

BACKGROUND OF THE INVENTION

The invention relates to a wellhead blowout preventer (BOP), including a production BOP capable of sealing against a central bore, and against a polish rod when in place.

The rams of a BOP may operate in different ways in closing off a well, or multiple BOPS may be used in a wellhead stack to provide different functions. In a production well, polish rod BOP rams accommodate and seal around a polish rod extending generally vertically through the wellhead. Blind BOP rams seal against each other across the central bore when no polish rod is in place.

A typical prior art BOP for a production wellhead is disclosed in U.S. Pat. No. 5,765,813 to Lam et al., issued Jun. 16, 1998, owned by Stream-Flo Industries Ltd., the assignee of this patent application. This type of BOP is commonly used in connection with pumping production wells. With such wells, a sucker rod string is reciprocated or rotated to drive a downhole pump, which lifts the produced fluid to surface through a tubing string. The BOP is equipped with polish rod rams which can be advanced horizontally to seal around the vertical polish rod portion of the rod string to prevent the upward escape of fluid. Alternatively, if the rod string is out of the well, the inner or front ends of the rams can be pressed together to cause closure of the wellhead assembly fluid passageway.

More particularly, the prior art BOP includes a cross-shaped housing forming a central vertical bore and a pair of coaxial, horizontal ram bores intersecting the central bore from each side. The BOP is commonly positioned in the wellhead assembly between the tubing head and flow tee. In such an embodiment, the BOP central bore forms part of the wellhead assembly fluid passageway. Within the BOP, a pair of rams is positioned in the horizontal ram bores. Actuators, such as screw jacks or other actuators (mechanical, electrical, pneumatic or hydraulic), are provided at the outer ends of the ram bores, for extending or retracting the rams into or out of the central bore, in order to close or open the central well bore. Each BOP ram comprises a generally cylindrical body, although other shaped ram bodies are known (ex. oval, rectangular or square in cross section). The ram generally comprises a steel core, preferably having an outer full bore diameter portion (or rear portion) and a reduced diameter inner portion (or front portion). The ram core inner portion is covered with and bonded to a layer of an elastomeric material, typically a nitrile rubber. The ram bores, typically cylindrical, extend into the central bore and the bore surfaces combine at their intersection to form sealing areas. When the rams move into the central bore, the rubber surfaces of their inner portions seal against the sealing surfaces.

The rubber-coated inner or front face of each ram is typically formed to provide a semi-circular, vertically directed groove, also termed vertical radial groove. When the polish rod of the rod string is present in the central bore, opposing ram ends encircle and press against the polish rod to form a seal of the central bore. When the polish rod is not present the ram ends compress together to form a solid block. In both cases, the circumferential seals of the ram side surfaces, with the sealing areas and the end face seals, combine to close the central bore and contain pressurized fluids.

U.S. Pat. No. 7,673,674, issued Mar. 9, 2010 to Tony M. Lam, and assigned to Stream-Flo Industries Ltd., the assignee for this patent application, describes a BOP ram and/or polish rod claim in which the vertically directed groove at the front face of the ram is shaped as a V-groove to accommodate a portion of the circumference of the polish rod. U.S. Pat. No. 7,552,765 to Tony M. Lam, issued Jun. 30, 2009, and assigned to Stream-Flo Industries Ltd., describes a BOP in which one of the rams is formed with an extended central bore sealing section behind the front sealing end of the ram, such that the extended central bore sealing section can be extended across the central bore to seal the central bore when the polish rod is not present.

In a production BOP, pressure acting from below on the closed BOP rams may extrude the side rubber upwardly so that the circumferential seal with the sealing areas is lost. As well, the end rubber bonded to the vertical end faces (front faces) of the ram cores may tear loose from the core when high pressure is exerted from below. In severe conditions, such as injecting chemicals to close off a well, the rubber degrades quickly, causing the seals to fail. A large number of BOP ram designs exist to address problems of extrusion, tearing or degradation of the BOP ram seals.

Canadian Patent Application No. 2,260,655, published Aug. 2, 2000 naming Tony M. Lam and Keith D. Farquharson as inventors and Stream-Flo Industries Ltd. as assignee, describes a ram type BOP for high temperature applications. The BOP incorporates a generally L-shaped seal element formed of a graphite or asbestos seal material, which is sandwiched between a bottom L-shaped steel retainer plate and a semi-cylindrically shaped steel top retainer plate. This design of BOP ram is well suited for brittle seal materials such as graphite and asbestos when higher temperatures are encountered.

Other ram type BOP devices exist which use graphite or asbestos type seals or seal inserts. However, graphite and asbestos type sealing materials typically include polymeric bonding materials which have lower temperature limits than graphite or asbestos, so the seals are prone to failure at very high temperatures, such as temperatures above 600° F. Today, high temperature wellhead applications such as steam injection may require the wellhead equipment to accommodate temperatures above 600° F. Also, the use of asbestos seal materials is being phased out in industry due to harmful effects of asbestos fibres in handling, manufacture and in use.

Thermoplastic materials having superior chemical resistance are available, but have different compressibility and elastic properties than elastomeric sealing materials such as nitrile rubbers. Thus, BOP devices are not generally amenable to simple substitution of thermoplastics for the rubber sealing components. U.S. Pat. No. 7,137,610, issued to Lam on Nov. 22, 2006, and assigned to Stream-Flo Industries Inc., describes a production BOP and BOP rams incorporating thermoplastic seals at the front of the rams to seal against the polish rod. However, even thermoplastic materials have temperature limits below the temperatures encountered for steam injection wellheads.

In spite of the above advances in BOP ram seals, there is still a need for BOP devices capable of withstanding very high or very low temperature environments. For instance, in wellheads through which steam is injected to enhance recovery in depleted wells or for heavy oil wells, temperatures in excess of 650° F. can be reached. These temperatures far exceed the limits of nitrile rubber seals, elastomeric seal materials, and thermoplastic seal materials. As above, BOP devices adapted to carry graphite or asbestos seals are also subject to failure at such extreme temperatures as polymeric bonding materials in the seals begin to break down. As well, at very low temperatures, conventional BOP sealing materials become very hard or brittle, interfering with their ability to make reliable seals.

There is a still a need for a ram type BOP which can reliably seal against a polish rod and/or the central bore of a wellhead in very high temperature and very low temperature applications.

SUMMARY OF THE INVENTION

In one broad aspect, there is provided a ram type blowout preventer which includes:

a) a housing forming a central bore extending generally vertically through the housing, and horizontal ram bores extending radially outwardly in opposite directions through the housing and intersecting the central bore;

b) a pair of rams, each ram having a front end portion, a rear end portion, a top portion and a bottom portion and being adapted to be positioned in one of the horizontal ram bores for sliding movement therein between an extended position, with the front end portion extending across the central bore and the rear portion within the horizontal ram bore, and a retracted position within the horizontal ram bore, each ram being configured with a front face to seal against the front face of the opposing ram and to accommodate a tubular member, if present in the central bore;

c) a primary rope packing seal formed on each ram from a first length of rope packing, the primary rope packing seal extending horizontally across the front face, rearwardly, and then either or both of upwardly over the top portion and downwardly over the bottom portion at a position rearwardly of the front end portion, the primary rope packing seal being held in, so as to protrude radially outwardly from, a continuous first groove formed in the ram, the continuous first groove being adapted to accommodate joined abutting ends or overlapping ends of the first length of rope packing; and d) an actuator connected to the rear end portion of each ram for extending and retracting the ram between the extended and retracted positions, e) such that in the extended position the primary rope packing seal on opposing ram front faces seal against each other, against the tubular member if present, and seals the central bore.

In one embodiment, to accommodate overlapping ends, the continuous first groove forms a widened portion at a location on the outer surface of the ram such that the overlapping ends of the first rope packing are oriented generally perpendicular to a longitudinal axis of movement of the ram in the horizontal ram bore. This widened portion may be located at the top portion of the ram to provide a dynamic seal.

In some embodiments, the BOP may further include a secondary rope packing seal formed from a second length of rope packing extending horizontally across the front face spaced from the primary rope packing seal, the secondary rope packing seal being held in, so as to protrude radially outwardly from, a second groove formed in the ram. The second groove may be a continuous second groove which extends across the front face of the ram and then generally rearwardly to meet the continuous first groove, and then the second length of rope packing for the second rope packing seal extends rearwardly within the continuous second groove such that the ends of the second length of rope packing meet the primary rope packing seal. Alternatively, the second groove may be a continuous second groove which extends across the front face of the ram, rearwardly and then either upwardly over the top portion of the ram, spaced from the primary rope packing, or downwardly over the bottom portion of the ram, spaced from the primary rope packing. In that embodiment, the second length of rope packing for the secondary rope packing seal extends within the continuous second groove and the continuous second groove is adapted to accommodate joined abutting ends or overlapping ends of the second length of rope packing.

In some embodiments, a circumferential seal may be formed on the ram rearwardly of the primary rope packing seal to seal the ram in the horizontal ram bore. This circumferential seal may be formed from a third length of rope packing held in a circumferential groove formed in the ram, the circumferential groove being adapted to accommodate joined abutting ends or overlapping ends of the third length of rope packing.

The front face of the BOP ram body may be formed with a vertical groove to accommodate a polish rod or other tubular member. In one embodiment the vertical groove is a radial groove. In another embodiment, the vertical groove is a V-groove. In yet other embodiments, the front face of the BOP ram body is formed as a blind ram to seal against an opposing ram without the polish rod.

The BOP has application in a wellhead assembly, including the BOP alone, or together in an integral composite assembly with one or more other wellhead components which might include, in any sequence, adaptors, control valves, additional BOPS, check valves, a flow tee, and a polish rod clamp. The wellhead assembly includes top and bottom connectors for connecting to wellhead components located above and below. Such connectors may be of any type, as is known in the industry, including for example studded connectors, flange connections, welded connections, clamp and threaded connections. Also provided are the BOP ram body components.

The rams and ram bores may be of any shape or configuration as is known in the BOP industry. While the figures show the rams and ram bores as being cylindrical in cross-section, they may be alternatively shaped, such as oval or rectangular in cross section. As used herein, the term "cylindrical" is understood to include rams and ram bores which are generally circular or oval in cross section.

It should be understood that the terms "front", "rear", "upper", "lower", "inner", "outer", "top" and "bottom", as used herein and in the claims with reference to the wellhead components and the BOP ram or its parts, refer to the component or ram as it is designed to be positioned in one of the horizontal ram bores, for longitudinal movement forward into the central bore or rearwardly in the horizontal ram bores. By "front", as used herein, is meant the portion or end of the ram or its parts at the central bore. By "rear" is meant the portion or end of the ram or its parts opposite the front. By "outer" is meant the outer circumferential portion of the ram or its parts. The term "central" in reference to the "central bore" is meant to include a generally vertical bore which may be somewhat off-center in the wellhead assembly, or somewhat inclined relative to vertical, such as occurs in horizontal or inclined oil/gas wells. Similarly, the term "horizontal ram bore" is meant to include generally horizontal ram bores which intersect the central bore at angles generally perpendicular to the axis of the central bore.

As used herein and in the claims, a reference to "a connection," "connected" or "connect(s)" is a reference to a sealed pressure-containing connection unless the context otherwise requires.

As used herein, "comprising" is synonymous with "including," "containing," or "characterized by," and is inclusive or open-ended and does not exclude additional, unrecited elements or method steps. The invention illustratively described herein suitably may be practiced in the absence of any element or elements, limitation or limitations which is not specifically disclosed herein.

The use of the indefinite article "a" in the claims before an element means that one of the elements is specified, but does not specifically exclude others of the elements being present, unless the context clearly requires that there be one and only one of the elements.

DETAILED DESCRIPTION OF THE INVENTION

Figure 1:
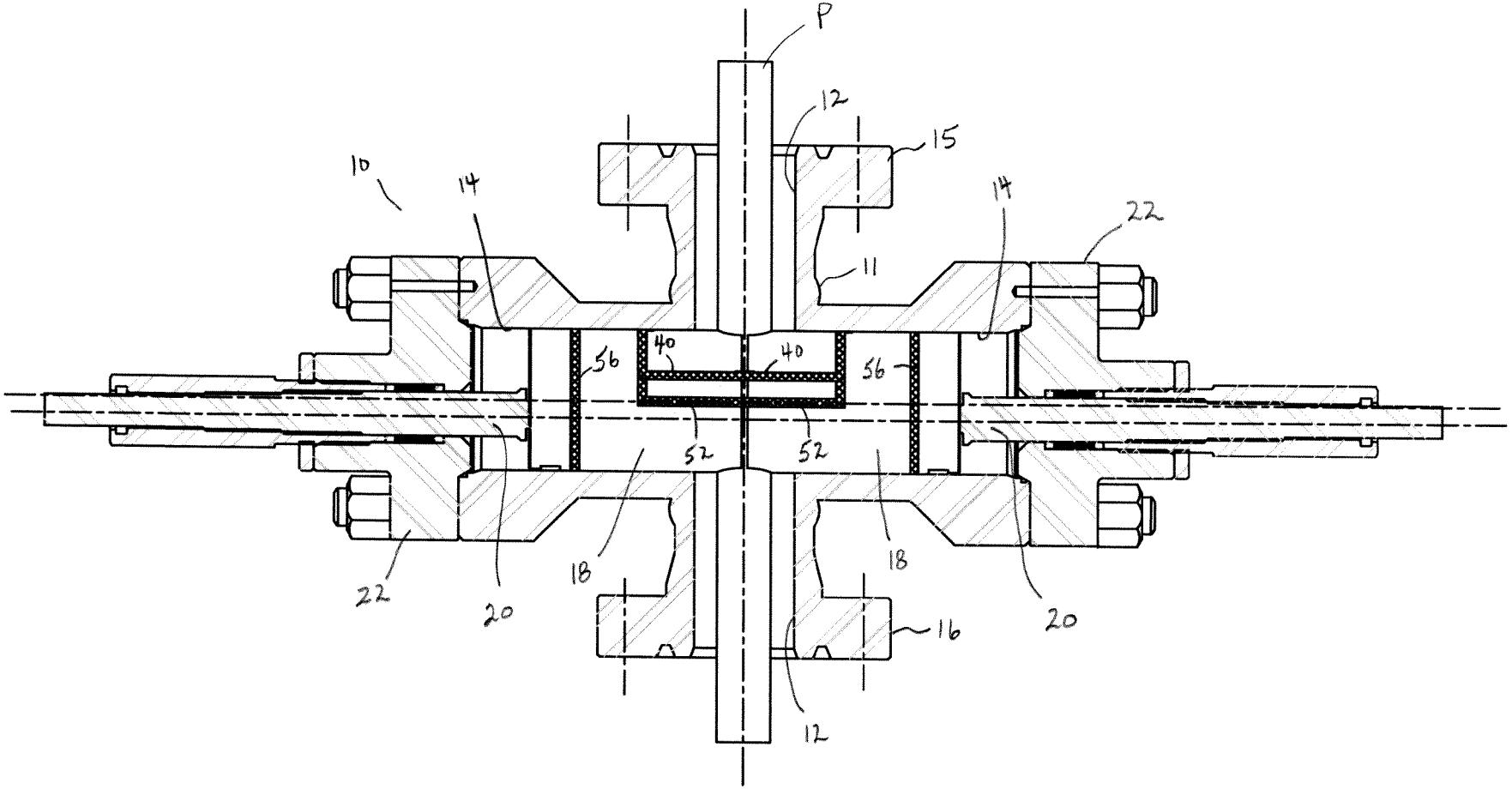
FIG. 1 is a side view of one embodiment of a production blowout preventer (BOP) showing the housing, end plugs and ram screws in section, and showing both of the BOP rams in an extended sealing position against a polish rod.

Multiple preferred embodiments of a production blowout preventer (BOP) and BOP rams adapted for a production BOP are shown in the Figures, with like parts being labeled with the same reference numerals.

Having reference to FIG. 1, a production blowout preventer (BOP) is shown generally at 10, to include a cross-shaped, pressure-containing steel housing 11 forming a central bore 12, extending generally vertically through the housing 11, and a pair of co-axial horizontal ram bores 14. The ram bores 14 are slightly larger in diameter than the central bore 12, as is common in BOP devices. Top and bottom flange connectors 15, 16 to wellhead components located above and below the BOP 10 are shown, although alternate top and bottom connectors such as threaded, welded, studded, or clamp connections may be used. The horizontal ram bores 14 intersect with the central bore 12. The polish rod P is shown in place in the central bore 12. The polish rod P is an example of a tubular member which may be present in the central bore.

Figure 4:
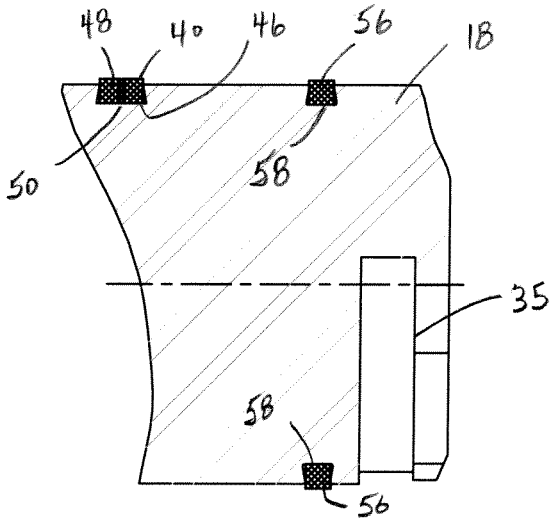
FIG. 4 is side sectional view along line 4-4 of FIG. 6, partially cut away, showing the overlapping ends of the primary rope packing seal at the top portion of the ram, and also showing a central T-slot at the rear of the ram to lock onto the ends of a ram screw used to extend and retract the ram.
Figure 5:
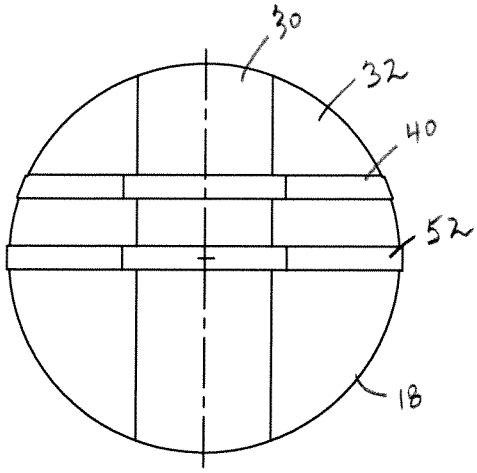
FIG. 5 is a partial front view of the ram of FIG. 2 showing the primary and secondary rope packing seals extending across the vertical radial groove.
Figure 6:
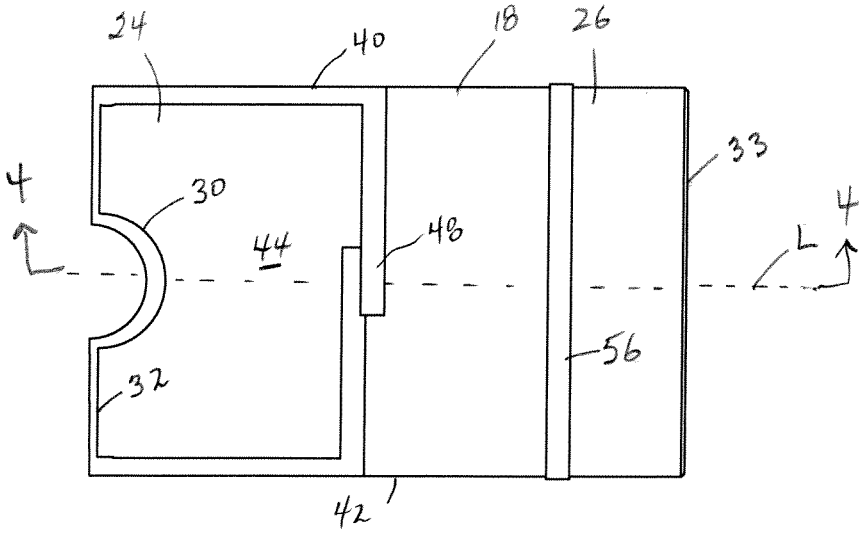
FIG. 6 is a top view of the ram of FIG. 2, showing the primary rope packing seal overlapping ends at the top portion of the ram.

A pair of generally cylindrical BOP rams 18 are shown in FIG. 1. Each of the rams 18 may be formed in multiple parts, but are generally cylindrically shaped when assembled for close fitting relationship in, and optionally for sealing to, the ram bores 14. The rams 18 are generally formed as steel bodied rams. The rams 18 are locked onto the ends of ram screws 20, which extend through end plugs or bonnets 22 at the outer ends of the ram bores 14. The ram screws 20 can be turned to extend or retract the rams 18 into or out of the central bore 12 with mechanical screw jacks (not shown). The ram screw 20 is connected at the rear face 33 of the ram 18, typically in a T-slot 35 (see FIG. 4), in a manner known in the art. Alternatively, the ram screws 20 can be extended and retracted with hydraulic actuators (not shown), as known in the art. It should be understood that the rams 18 may be alternately actuated, for instance by pneumatic or electrical actuators. Actuators may be single or double acting, as known in the art. Any of these mechanical screw jacks or alternate actuators thus illustrate actuators for extending and retracting the rams 18 between their open position, in which the rams 18 are retracted from the central bore 12, and the closed, sealing position, in which the opposing rams 18 are extended to seal around the polish rod P, and thus to seal the central bore from pressure below.

It should be understood that one of the rams, along with the ram bores, may be adapted to include and accommodate an extended central bore sealing section as described in U.S. Pat. No. 7,552,765.

It should be understood that the ram bores 14 and corresponding rams 18 are not necessarily strictly cylindrical in shape. The rams and bores may take alternate shapes, such as oval in cross section, or even rectangular in cross section, as is known in the art.

Figure 2:
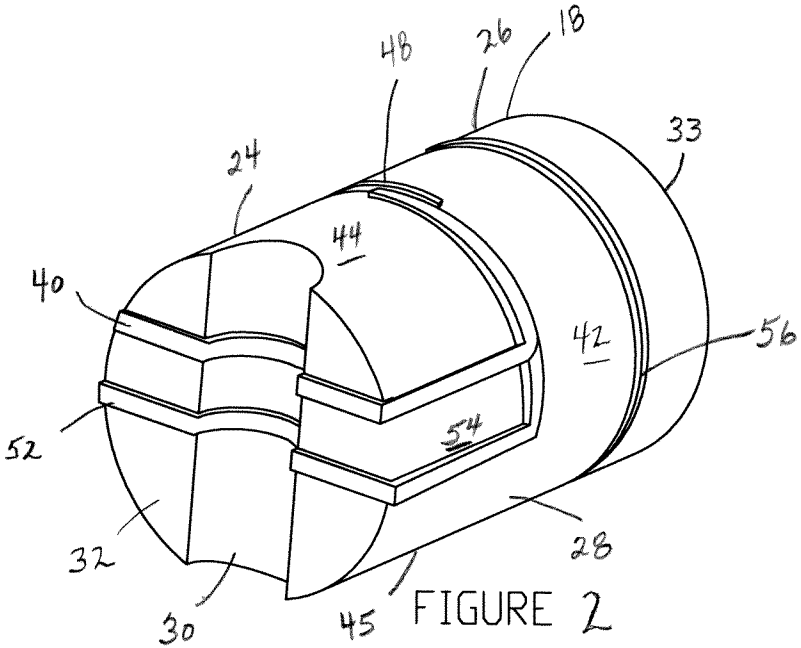
FIG. 2 is a perspective view of one of the BOP rams from FIG. 1, formed with a radial vertical groove at its front face to accommodate a polish rod, and showing a primary rope packing seal, a secondary rope packing seal spaced from the primary rope packing seal, and a circumferential rope packing seal formed rearwardly of the primary and secondary rope packing seals. Each rope packing for these seals is held in continuous grooves formed in the ram.
Figure 3:
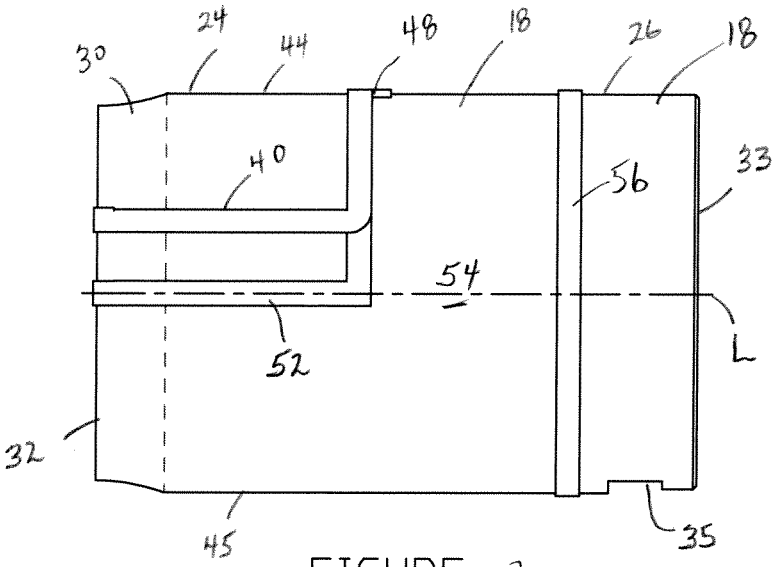
FIG. 3 is a side view of the BOP ram of FIG. 2.

A first embodiment of a ram 18 is shown in FIG. 2. In FIG. 1, this first embodiment of a pair of rams 18 are shown in their fully extended, sealing position, with opposing front faces 32 (see FIG. 2) sealed against each other, against the polish rod P, and against the central bore 12. The seal arrangement is one in which the rams 18 carry seals adapted to seal the central bore 12 against pressure from below. However, it should be understood that the rams 18 may be rotated or configured in a different manner. For example, a ram which is rotated 180° compared to FIG. 1, will seal the central bore 12 against pressure from above. A ram which carries additional mirror image seals on the bottom portion of the ram, compared to FIGS. 1 and 2, will seal the central bore 12 against pressure from above and below. Thus, while embodiments are described which seal against pressure from below, these are only exemplary, and not limiting, embodiments.

Each ram 18 includes a front end portion 24 (this being the portion which extends into the central bore 12 in the extended position) and a rear end portion 26 (facing the end plugs 22, and which remains within the horizontal ram bore 14 in the retracted and extended positions). The ram bores 14 are each of sufficient length to accommodate the ram 18 in its fully retracted, open position or its fully extended, sealing position.

Each ram 18 is formed from a steel body component 28 which is generally cylindrical in shape for a tight fitting seal in the ram bore 14. The body component 28 may be formed in multiple components which are assembled to form a cylindrical ram, but a single piece steel body component is shown in the Figures.

Figure 7:
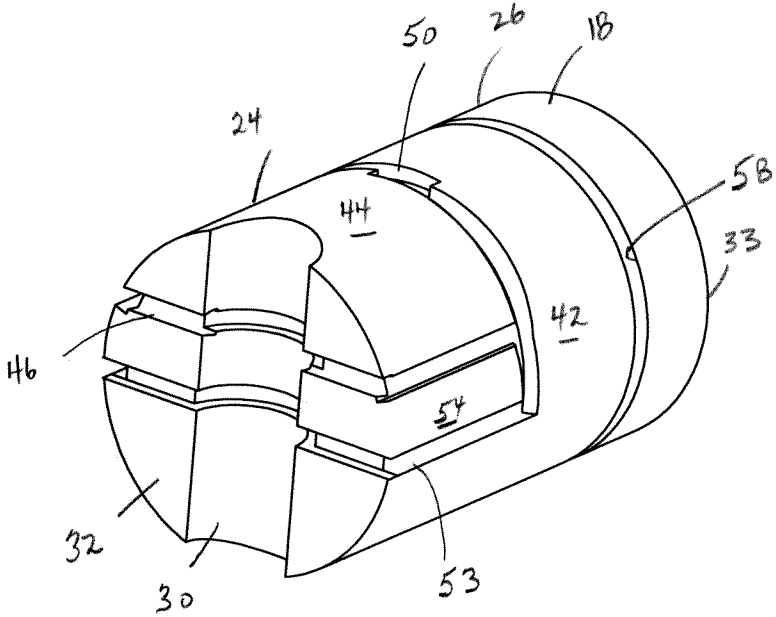
FIG. 7 is a perspective view of the ram of FIG. 2, with the primary and secondary rope packing seals removed, showing the dove-tail shaped grooves to retain the lengths of rope packings.
Figure 8:
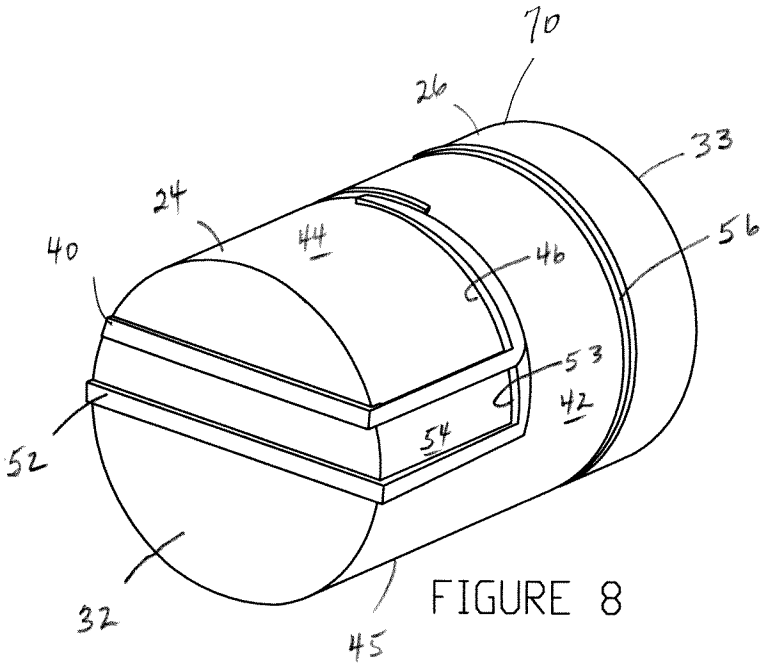
FIG. 8 is a perspective view of a further embodiment of a BOP ram having a blind front face for sealing across the central bore when a polish rod is not present, and incorporating primary and secondary rope packing seals.
Figure 9:
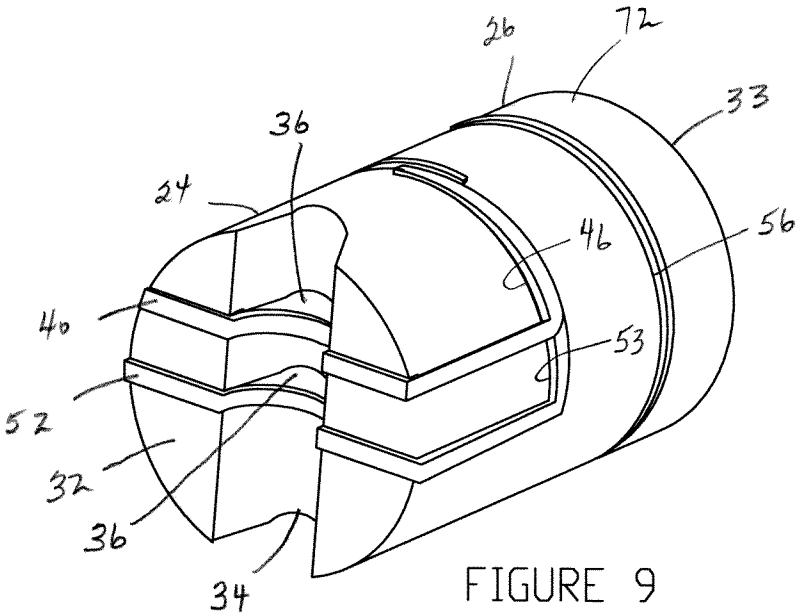
FIG. 9 is a perspective view of a further embodiment of a BOP ram having a V-shaped vertical groove at its front face, and including the primary and secondary rope packing seals.

The ram 18 is formed with a vertical groove 30 that runs along the front face 32 of the ram 18 to accommodate the polish rod P or other tubular member. In FIGS. 2, 3, 5, 6, 7 and 10, the vertical radial groove is shown as generally semi-circular (in horizontal cross section). The vertical groove 30 may be omitted if the front ends of the rams 17, 18 are to function as blind rams 70 to seal against each other in the event that the polish rod is not present, as shown in FIG. 8. Still alternatively, the vertical groove may take the form of a vertical V-groove 34 running along the front face 32, as shown in FIG. 9, and as described in U.S. Pat. No. 7,673,674. The V-groove 34 is sized to accommodate at least a portion of the circumference of the polish rod within the groove 34. In the V-groove embodiment of FIG. 9, one or more radial shaped, raised backing sections 36 (two shown in FIG. 9) are formed at sealing locations within the V-groove, these backing sections being sized to accommodate the polish rod P in a tight fitting relationship.

Figure 10:
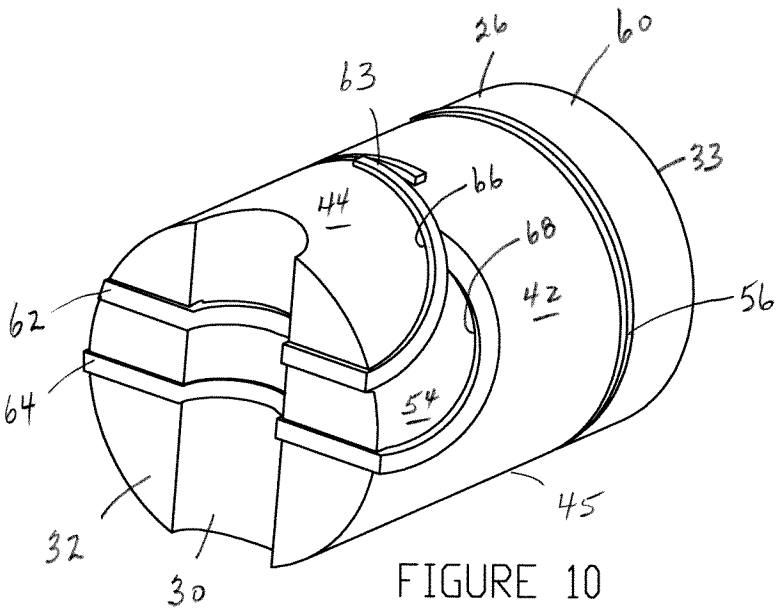
FIG. 10 is a perspective view of a further embodiment of a BOP ram having a alternate spacing arrangement of the primary and secondary rope packing seals.

As shown in FIG. 2, each of the rams 18 include at least one rope packing seal, shown as primary rope packing seal 40. The primary rope packing seal 40 is formed from a length of rope packing which forms a closed loop on the outer surface of the ram 18. The length of rope packing, and thus the primary rope packing seal 40 extends horizontally across the front face 32 of the ram 18, including across the vertical groove 30, then generally rearwardly, and then upwardly around a portion of the outer surface of the ram 18 and over the top portion 44 of the ram 18. Although not shown, the primary rope packing seal 40 could alternatively, or in addition, extend over the bottom portion 45 of the ram 18. In order to seal the central bore 12, the location where the primary rope packing seal 40 extends over the top portion 44 (or bottom portion 45) is at a position on the ram 18 rearwardly of the front portion 24, such that the seal 40 at the top portion 44 remains within the ram bore 14 when the ram 18 is fully extended (see FIG. 1). In FIG. 2, the primary rope packing seal 40 is shown to extend rearwardly along the side wall 42 of the ram 18, and then circumferentially upwardly across the top portion 44 of the ram 18. Alternatively, the primary rope packing seal could extend in an arcuate path, both rearwardly and upwardly, such as shown in FIG. 10 (labeled as primary rope packing seal 62, and described below). Thus the terms "rearwardly", "upwardly" and "downwardly" as used herein and in the claims are not meant to refer to strict horizontal or vertical orientations, but are meant to include arcuate paths.

The primary rope packing seal 40 is preferably formed from a single length of rope packing. While multiple lengths could be used, a single length minimizes the number of joining ends to be accommodated, and thus minimizes weaknesses in the seal. The primary rope packing seal 40 is held within a continuous first groove 46 (see FIG. 7) machined into the steel body component 28 to underlie the path of the rope packing seal 40. For the rams 18 shown in FIGS. 1-10, the continuous first groove 46 is shown to be adapted to accommodate overlapping end portions 48 (overlapping ends) of the length of rope packing material in a manner to form a dynamic seal as the BOP ram 18 is extended or retracted in the ram bore 14. The overlap is shown in the Figures to be positioned at the top portion 44 of the ram 18, such that the overlapping ends 48 are positioned side by side, and are directed generally perpendicularly to the longitudinal axis L of the ram 18 (see FIG. 6). In this way, as the ram 18 is moved longitudinally along its axis L, the overlapping end portions 48 are compressed together by the extending/retracting movement of the ram 18. This is preferable to locating overlapping end portions at a position such that they are parallel to the longitudinal axis of movement of the rams 18, since parallel overlapped ends may tend to be pulled apart by the extending/retracting movement of the ram 18. To accommodate the overlapping side by side end portions 48, the continuous first groove 46 is machined, preferably at the top portion 44, with a widened groove portion 50 (see FIGS. 4 and 7) sized to accommodate two diameters of the overlapping ends 48 of the rope packing material in a compressed manner as the overlapping ends 48 lie side by side. This side by side overlapping ends 48 arrangement is shown within the widened groove portion 50 in FIGS. 4 and 6.

Figure 11:
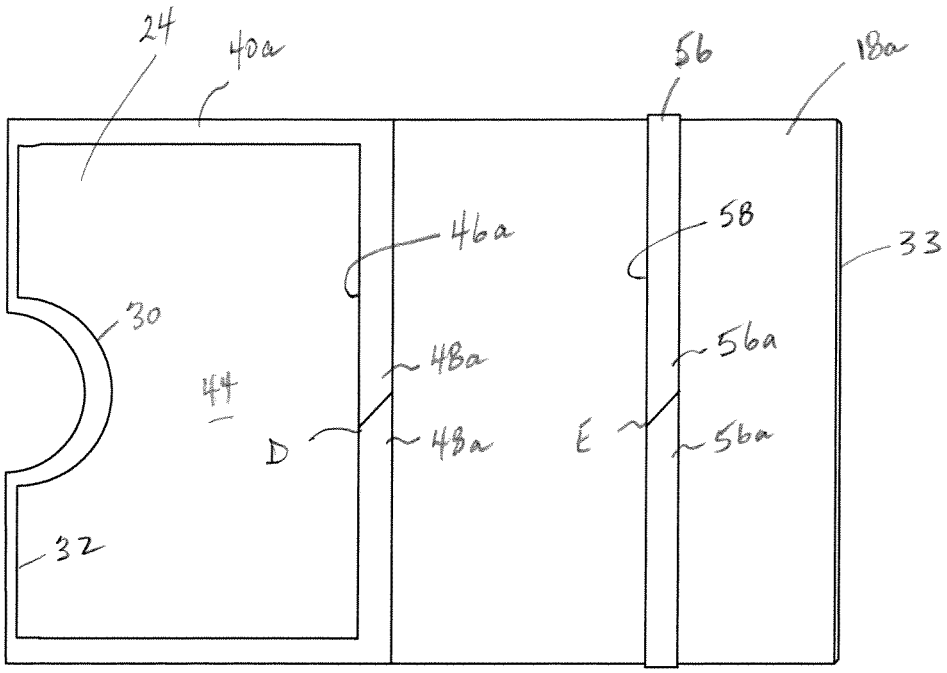
FIG. 11 is a top view of a further embodiment of a BOP ram, showing joined abutting ends of the primary rope packing seal and the circumferential rope packing seal, with the joined abutting ends both being located at the top portion of the ram.

Alternatively, a continuous first groove may be formed to accommodate joined abutting ends of the rope packing. This is shown as a top view in the embodiments of rams 18*a*, 18*b* and 18*c* in FIGS. 11-13. In these Figures, the primary rope packing seal is shown at 40*a*, in a continuous first groove 46*a* (without a widened portion), but with the ends 48*a* of the rope packing being cut on a diagonal angle, for example a 45° angle, at D such that they join (i.e., meet) with each other as joined abutting ends 48*a* within the groove 46*a*. As above, the joined abutting ends 48*a* are preferably joined at a location such that the ends are directed generally perpendicularly to, or diagonally across, the longitudinal axis of the ram. This minimizes pulling apart action on the ends 48*a* as the ram 18*a*, 18*b*, 18*c* is extended and retracted in the ram bores 14.

The continuous first groove 46 is preferably sized with a depth dimension which is slightly undersized relative to the diameter or side dimension of the rope packing. The opening dimension of the continuous first groove 46 may also be undersize relative to the diameter or side dimension of the rope packing. Either or both of these techniques assist with the rope packing being held in the groove 46, while protruding radially from the groove 46, to provide the seal to sealing surfaces of the housing 11. A dove-tail shaped groove shape (see cross section of groove in FIG. 4) is particularly preferred to hold and retain the rope packing against dislodging. The groove 46 is best illustrated in FIG. 7, in which the rope packing seal 40 is removed. A "dove-tail shaped" groove is a groove which, in cross section, is sized smaller at its opening dimension than it is at the bottom wall dimension of the groove, for example generally trapezoidal shaped. However, other groove shapes such as generally round or square (in cross section) may be used. Rope packing materials are particularly amenable to being compressed into grooves of different shapes, so as to be retained therein, while also protruding therefrom.

As shown in FIG. 2, the ram 18 may include a secondary rope packing seal 52. This secondary rope packing seal 52 has particular application in higher pressure sealing applications.

The secondary rope packing seal 52 may be formed from a second single length of rope packing. The secondary rope packing seal 52 extends in a continuous length, horizontally across the front face 32 of the ram 18, including across the vertical groove 30 (preferably parallel and below the primary rope packing seal 40). The rope packing seal 52 then extends rearwardly along the side wall 42 of the ram body 28 (for example parallel and spaced below the primary rope packing seal 40), and upwardly to meet the primary rope packing seal 40. As shown in FIG. 7 (rope packing seals 40, 52 removed), the secondary rope packing seal 52 is held within a continuous second groove 53 machined into the steel body component 28 to underlie the secondary rope packing seal. The second groove 53 is preferably undersized in its depth dimension, and preferably dove-tail shaped, as set forth above for first groove 46 and/or 46*a*. At the point where the secondary rope packing seal 52 meets the primary rope packing seal 40, the grooves 53 and 46 are continuous with each other (see FIG. 7).

Alternatively, the secondary rope packing seal may extend rearwardly and then upwardly (or downwardly), spaced from the primary rope packing seal, and around the top portion or bottom portion of the ram to form a closed loop. In such embodiments, a continuous second groove adapted to hold the secondary rope packing seal is adapted to accommodate joined or overlapping ends of the rope packing as set out above for the primary rope packing seal.

In the Figures, the primary rope packing seal 40 is shown to extend rearwardly at a location which is above the central portion 54 of the ram 18 (i.e, above a central horizontal cross section line through the ram), and then over the top portion 44 of the ram 18. In this manner, upward pressure along the central bore 12 assists in sealing the ram 18 in its extended sealing position, as the primary rope packing seal 40 is radially compressed against the wall of the ram bores 14. The secondary rope packing seal 52 (if present), may be located horizontally below the primary rope packing seal 40, for example at or near the central portion 54 of the ram 18 (i.e., closer to a central horizontal cross section line through the ram). However, other locations of the rope packing seals 40, 52 are possible. For instance, if a bidirectional BOP sealing ram is needed, the BOP ram may be formed with a primary rope packing seal 40 such as shown in the Figures, located above the central portion 54 of the ram 18, and with a further rope packing seal (not shown) located as a mirror image below the central portion of the ram 18.

It should be also be apparent that the rams 18 as shown in the Figures could be rotated for positioning in the ram bores 14 such that the rope packing seals 40 and/or 52 are located below and at the central portion of the ram 18. Further, the rams 18 might be modified to include a upper rope packing (such as primary rope packing seal 40), a lower rope packing seal which may be a mirror image of the upper rope packing seal, and a central rope packing seal located horizontally between the upper and lower rope packing seals, and which extends upwardly and downwardly at its sides to join with the upper and lower rope packing seals.

Figure 12:
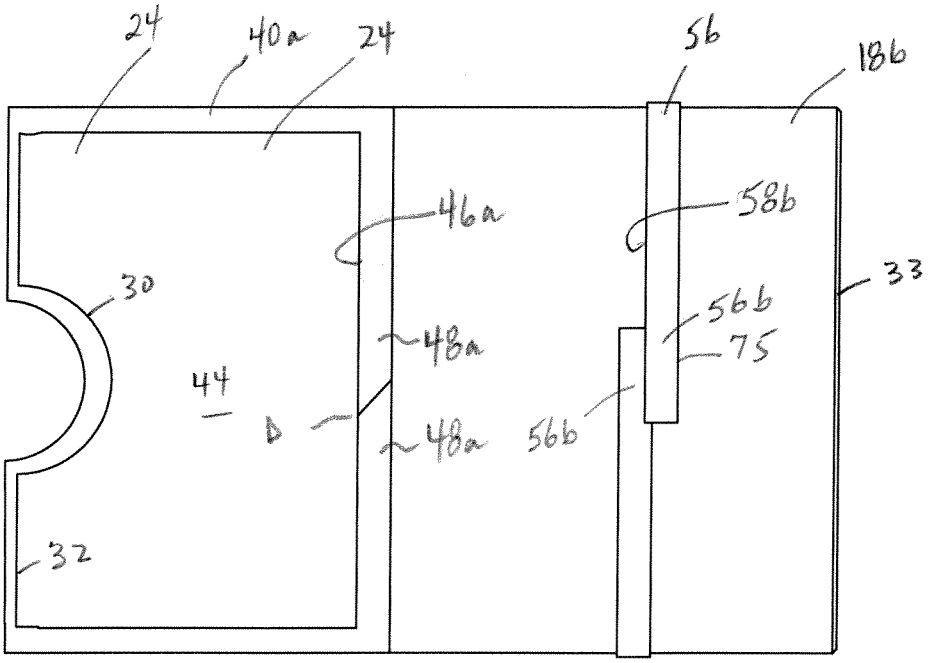
FIG. 12 is a top view of a further embodiment of a BOP ram, showing joined abutting ends of the primary rope packing seal, and overlapping ends of the circumferential rope packing seal, with the joined abutting ends and the overlapping ends being located at the top portion of the ram.
Figure 13:
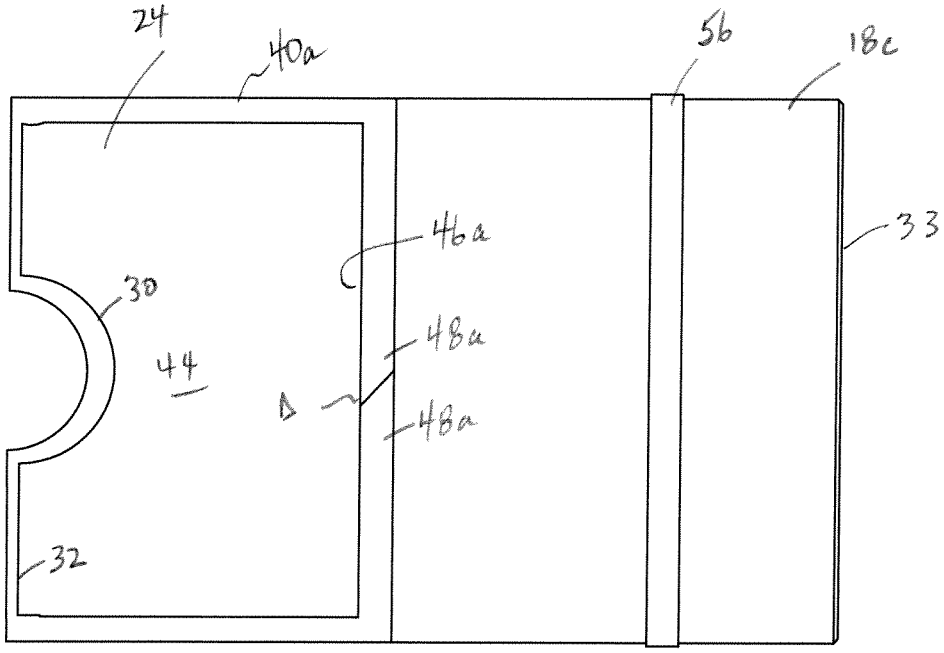
FIG. 13 is a top view of a further embodiment of a BOP ram, showing joined abutting ends of the primary rope packing seal at the top portion of the ram, and joined abutting ends of the circumferential rope packing seal located at the bottom portion of the ram.

The rear end portion 26 of the ram 18 may be formed with a circumferential seal 56 to seal the ram bores 14. In some BOP embodiments the end plugs or bonnet 22 may be used to seal the ends of the ram bores 14, so the circumferential seal 56 may be omitted in such embodiments. This circumferential seal 56 may be formed from a length of rope packing material to comprise a circumferential rope packing seal 56. The ram 18 may be formed with a continuous circumferential groove 58 at the rear end portion 26 to underlie the rope packing circumferential seal 56. The circumferential groove 58 may be formed to accommodate joined abutting ends 56*a* cut on a diagonal angle at E (not shown in FIG. 1-10 or 13, but shown at the top portion 44 of ram 18*a* in FIG. 11). Alternatively, as shown in FIG. 12 for ram 18*b*, the circumferential groove 58*b* may be formed with a widened portion 75 to accommodate overlapped ends 56*b* as described above for the primary rope packing seal 40. For the circumferential seal 56, the location of the widened portion or joined abutting ends is not critical, since the ends will be positioned perpendicular to the longitudinal axis of ram movement regardless of its location. In this way, the circumferential seal 56 also functions as a dynamic seal.

FIG. 10 illustrates alternate embodiment of a ram 60, in which the primary rope packing seal 62 extends horizontally across the front face 32, including across the vertical groove 30, and then extends rearwardly and upwardly along an arcuate path to meet at the top portion 44 of the ram 18, where overlapped end portions 63 are accommodated as described above. Similarly, the secondary rope packing seal 64 extends horizontally across the front face 32, including across the vertical groove 30, but spaced below the primary rope packing seal 62, and then extends rearwardly and upwardly along an arcuate path to meet the primary rope packing seal 62. The rope packings for these seals 62 and 64 are held in first, second grooves 66, 68 machined in the body component 28, and positioned to underlie the seals 62, 64.

In the embodiment of FIG. 8, the primary and secondary rope packing seals 40, 52 are as described above, but being a blind ram 70, no vertical groove is formed in the front face of the ram 70.

In the embodiment of FIG. 9, the primary and secondary seals 40, 52 are generally as described above for FIG. 2, but in a ram 72 formed with a vertical V-groove 34 to accommodate the polish rod P (not shown), the rope packing seals 40, 52 are formed on the radial backing sections 36, with the first and second grooves 46, 53 being machined horizontally across these backing sections 36. A circumferential seal 56 is formed in the rear portion 26, as described above for FIG. 2. Other aspects of the V-groove ram are more fully described in U.S. Pat. No. 7,673,674.

The rope packing seals may be made from any known rope packing seal materials. Rope packings are available in many different forms, for example, braided, twisted, woven and knitted. The rope packing may have a core material which differs or is the same as the outer sealing material in composition, for example higher temperature seal material may be used over lower temperature core materials. As well, the rope packing may be reinforced, for example with wire reinforcing materials such as steel, copper or stainless steel. The cross sectional shape may vary, such as square, square with rounded corners, oval or circular, with square being preferred. The continuous groove in the rams can be varied to accommodate and hold different cross sectional shapes of rope packings. Examples of rope packings include braided cotton twill, braided ramie fibre, braided tallowed rayon, tallowed flax graphite, braided jute yarn, braided glass fibre, aluminum foil, braided copper wire, braided PTFE materials (polytetrafluoroethylene such as Teflon®), Teflon impregnated braided asbestos, braided ceramics, braided asbestos, and braided graphite. One exemplary material for very high temperature applications is graphite rope packing which is stainless steel reinforced, with a square cross section and a side dimension of about 0.8 cm. Diameters of rope packing ranging from about 0.5 cm to 2 cm may be used. The rope packing is threaded or pressed into the machined grooves 46, 53, 58 for example with a hammer, or other known rope packing threading tools/devices.

Each of the primary and circumferential rope packing seals (and in some embodiments the secondary rope packing seal), by being formed from a length of rope packing arranged as a closed loop, and being held in a continuous groove which accommodates either joined abutting ends, or overlapping ends in side by side relationship, is able to provide a dynamic seal on a blowout preventer ram.

In general, rope packings have been previously used only as static seals in the wellhead equipment, where the seal remains generally static during seal operation/energization. Examples of static rope packing seal applications include annular seals on rotating or translating pipes, shafts or stems (ex. stuffing box seals), or in place of O-ring seals on tubulars such as tubing hangers. The BOPS and rams described herein accommodate rope packings as a dynamic (moving) seal. This enables higher temperature rope packing materials to be used. For instance, graphite reinforced stainless steel rope packing materials have been rated up to about 1000° F., high enough for wellheads designed for steam injection or other very high temperature heating applications. Rope packing materials for very low temperatures applications may also be accommodated.

The BOP as described above and/or the BOP rams may be adapted to be included in a composite wellhead assembly including, between a top connector and a bottom connector, together with one or more of the following components, in any sequence, adapters, valves, gate valves, flow tee, additional blowout preventers, and polish rod clamp. To that end, attention is directed to the devices disclosed in the following U.S. Patents, all of which are commonly owned by Stream-Flo Industries Ltd.: U.S. Pat. No. 5,743,332, issued Apr. 28, 1998, entitled "Integral Wellhead Assembly for Pumping Wells"; U.S. Pat. No. 6,457,530, issued Oct. 1, 2002, entitled "Wellhead Production Pumping Tree"; U.S. Pat. No. 6,176,466, issued Jan. 23, 2001, entitled "Composite Pumping Tree with Integral Shut-Off Valve"; and U.S. Pat. No. 6,595,278, issued Jul. 22, 2003, entitled "Assembly for Locking a Polished Rod in a Pumping Wellhead". Each of these patents discloses wellhead equipment used in connection with pumping oil wells, but in a composite form, meaning that one or more functional components of a conventional pumping tree are included in an integral body housing between a top and a bottom connector. Such components may include a shut off valve, a blowout preventer, a flow tee and an adapter. As a composite wellhead, the components are included in a integral tubular body formed from a single piece of steel, and forming an axial, vertical or central fluid flow bore extending therethrough. Multiple side openings are formed in the body, each communicating with the vertical bore, in order to house the valve, BOP and flow tee components. The body includes a bottom connector for connection with the component located therebelow, for example a flanged top connection of a tubing head. This bottom connection might be a studded down connection, or any other bottom connector such as a flanged connection, clamp-hub connection, rotatable flange connection, welded connection or threaded connection. The body may include a valve housing section above the bottom connection to house a conventional gate valve assembly operative to open or close the central bore. Above the valve housing section may be a first BOP housing section, adapted to house the ram assembly components of one or more of the above-Figures described above. A second BOP housing section may optionally be formed in the body above the first BOP housing section, housing same or different ram or polish rod clamp components as described above. Above the second BOP housing is typically a flow tee housing section for connection with a conventional flow line, through which well fluid is produced. The body forms a top connector at its upper end for connection with the wellhead component located thereabove, typically a stuffing box. The top connector may include studded connectors, but any other type of connector as indicated above for the bottom connector, may be substituted, as known in the art. As indicated, this is only one exemplary composite wellhead assembly. The components may be provided in different sequences, and may be varied, added or omitted as is appropriate for the needs of a particular wellhead All references mentioned in this specification are indicative of the level of skill in the art of this invention. All references are herein incorporated by reference in their entirety to the same extent as if each reference was specifically and individually indicated to be incorporated by reference. However, if any inconsistency arises between a cited reference and the present disclosure, the present disclosure takes precedence. Some references provided herein are incorporated by reference herein to provide details concerning the state of the art prior to the filing of this application, other references may be cited to provide additional or alternative device elements, additional or alternative materials, additional or alternative methods of analysis or application of the invention.

The terms and expressions used are, unless otherwise defined herein, used as terms of description and not limitation. There is no intention, in using such terms and expressions, of excluding equivalents of the features illustrated and described, it being recognized that the scope of the invention is defined and limited only by the claims which follow. Although the description herein contains many specifics, these should not be construed as limiting the scope of the invention, but as merely providing illustrations of some of the embodiments of the invention.

One of ordinary skill in the art will appreciate that elements and materials other than those specifically exemplified can be employed in the practice of the invention without resort to undue experimentation. All art-known functional equivalents, of any such elements and materials are intended to be included in this invention. The invention illustratively described herein suitably may be practiced in the absence of any element or elements, limitation or limitations which is not specifically disclosed herein.

What is claimed is:

1. A ram type blowout preventer, comprising:

a housing forming a central bore extending generally vertically through the housing, and horizontal ram bores extending radially outwardly in opposite directions through the housing and intersecting the central bore;

a pair of rams, each ram having a front end portion, a rear end portion, a top portion and a bottom portion and being adapted to be positioned in one of the horizontal ram bores for sliding movement therein between an extended position, with the front end portion extending across the central bore and the rear end portion within the horizontal ram bore, and a retracted position within the horizontal ram bore, each ram being configured with a front face to seal against the front face of the opposing ram and to accommodate a tubular member, if present in the central bore;

a primary rope packing seal formed on each ram from a first length of rope packing of a rope packing material in a braided, twisted, woven or knitted form, the primary rope packing seal extending horizontally across the front face, rearwardly, and then either or both of upwardly over the top portion and downwardly over the bottom portion at a position rearwardly of the front end portion, the primary rope packing seal being held as a closed loop in, so as to protrude radially outwardly from, a continuous first groove formed in the ram, the continuous first groove being adapted to accommodate joined abutting ends or overlapping ends of the first length of rope packing; and an actuator connected to the rear end portion of each ram for extending and retracting the ram between the extended and retracted positions, such that in the extended position the primary rope packing seals on opposing rams seal against each other on opposing front faces, against the tubular member if present, and against the ram bores so that the primary rope packing seals themselves seal the central bore.

2. The blowout preventer of claim 1, wherein the continuous first groove forms a widened portion at a location on the ram such that the overlapping ends of the first rope packing are held side by side and are oriented generally perpendicular to a longitudinal axis of movement of the ram in the horizontal ram bore.

3. The blowout preventer of claim 2, wherein the widened portion is formed at a top portion of the ram.

4. The blowout preventer of claim 2, further comprising a secondary rope packing seal formed on each ram from a second length of rope packing of a rope packing material in a braided, twisted, woven or knitted form extending horizontally across the front face, and being spaced from the primary rope packing seal, the secondary rope packing seal being held in, so as to protrude radially outwardly from, a second groove formed in the ram.

5. The blowout preventer of claim 4, wherein the primary rope packing seal is pressed or threaded into the continuous first groove and the secondary rope packing seal is pressed or threaded into the second groove.

6. The blowout preventer of claim 5, wherein the second groove is a continuous second groove which extends across the front face of the ram and then generally rearwardly to meet the continuous first groove, and wherein the second length of rope packing for the second rope packing seal extends rearwardly within the continuous second groove such that the ends of the second length of rope packing meet the primary rope packing seal.

7. The blowout preventer of claim 5, wherein the second groove is a continuous second groove which extends across the front face of the ram, rearwardly and then either upwardly over the top portion of the ram, spaced from the primary rope packing, or downwardly over the bottom portion of the ram, spaced from the primary rope packing, and wherein the second length of rope packing for the secondary rope packing seal extends within the continuous second groove, the continuous second groove being adapted to accommodate the overlapping ends of the second length of rope packing.

8. The blowout preventer of claim 7, wherein the second groove extends across the front face of the ram below the primary rope packing, rearwardly and then upwardly over the top portion of the ram, spaced from the primary rope packing, and wherein the continuous second groove forms a widened portion at the top portion of the ram such that the overlapping ends of the second rope packing are held side by side and are oriented generally perpendicular to a longitudinal axis of movement of the ram in the horizontal ram bore.

9. The blowout preventer of claim 5, further comprising a circumferential seal formed on the rear end portion of the ram rearwardly of the primary rope packing seal to seal the ram in the horizontal ram bore.

10. The blowout preventer of claim 9, wherein the circumferential seal is formed from a third length of rope packing of a rope packing material in a braided, twisted, woven or knitted form held in a continuous circumferential groove formed in the ram, the circumferential groove being adapted to accommodate joined abutting ends or overlapping ends of the third length of rope packing.

11. The blowout preventer of claim 10, wherein either or both of the second groove and the circumferential groove is formed with a widened portion to accommodate overlapping ends of the second length of rope packing or overlapping ends of the third length of rope packing in side by side relationship, the widened portion being formed at a location on the outer surface of the ram such that the overlapping ends are oriented generally perpendicular to a longitudinal axis of movement of the ram in the horizontal ram bore.

12. The blowout preventer of claim 11, wherein one or more of the first groove, the second groove and the circumferential groove is generally dove-tail shaped in cross section to hold the rope packings.

13. The blowout preventer of claim 12, wherein the ram is formed as a blind ram such that the front face of opposing rams seal against each other in the extended position to seal the central bore.

14. The blowout preventer of claim 12, wherein the front face of the ram is formed with a vertical groove to accommodate the tubular member comprising a polish rod.

15. The blowout preventer of claim 14, wherein the vertical groove is a radial groove.

16. The blowout preventer of claim 14, wherein the vertical groove is V-shaped to accommodate at least a portion of the circumference of the polish rod within the V-groove, and wherein the primary rope packing seal, and the secondary rope packing seal if present, extends across a raised radial backing section formed in the V-groove to seal to the polish rod.

17. The blowout preventer of claim 12, wherein: the horizontal ram bores are generally cylindrical, and the rams are steel bodied rams and are generally cylindrical.

18. The blowout preventer of claim 1, wherein the joined abutting ends of the first rope packing are oriented generally perpendicular to, or diagonally across, a longitudinal axis of movement of the ram in the horizontal ram bore and wherein the joined abutting ends of the first rope packing are located at the top portion or the bottom portion of the ram.

19. The blowout preventer of claim 1, further comprising a secondary rope packing seal formed on each ram from a second length of rope packing of a rope packing material in a braided, twisted, woven or knitted form extending horizontally across the front face, and being spaced from the primary rope packing seal, the secondary rope packing seal being held in, so as to protrude radially outwardly from, a second groove formed in the ram.

20. The blowout preventer of claim 1, further comprising a circumferential seal formed on the rear end portion of the ram rearwardly of the primary rope packing seal to seal the ram in the horizontal ram bore.

21. The blowout preventer of claim 1, wherein the ram is formed as a blind ram such that the front face of opposing rams seal against each other in the extended position to seal the central bore.

22. The blowout preventer of claim 1, wherein the front face of the ram is formed with a vertical groove to accommodate the tubular member comprising a polish rod.

23. The blowout preventer of claim 1, wherein: the horizontal ram bores are generally cylindrical, and the rams are steel bodied rams and are generally cylindrical.

24. The blowout preventer of claim 1, wherein the housing provides a top connector and a bottom connector for connecting and sealing to a wellhead component located above and below the housing.

25. The blowout preventer of claim 1, configured as a composite wellhead assembly and further comprising, between a top connector and a bottom connector, one or more of the following wellhead components, in any sequence: an adapter, a valve, a gate valve, a flow tee, a second blowout preventer, and a polish rod clamp.

26. The blowout preventer of claim 1, wherein the rope packing material is graphite rope packing which is wire reinforced.

27. A ram for use as part of a ram type blowout preventer in a wellhead, the wellhead providing a housing forming a central bore extending generally vertically through the housing, and horizontal ram bores extending radially outwardly in opposite directions through the housing and intersecting the central bore, the ram comprising:

a ram body having a front end portion, a rear end portion, a top portion and a bottom portion and being adapted to be positioned in one of the horizontal ram bores for sliding movement therein between an extended position, with the front end portion extending across the central bore and the rear end portion within the horizontal ram bore, and a retracted position within the horizontal ram bore, the ram body being configured with a front face to seal against the front face of an opposing ram body and to accommodate a tubular member, if present in the central bore; and a primary rope packing seal formed on the ram body from a first length of rope packing of a rope packing material in a braided, twisted, woven or knitted form, the primary rope packing seal extending horizontally across the front face, rearwardly, and then either or both of upwardly over the top portion and downwardly over the bottom portion at a position rearwardly of the front end portion, the primary rope packing seal being held as a closed loop in, so as to protrude radially outwardly from, a continuous first groove formed in the ram body, the continuous first groove being adapted to accommodate joined abutting ends or overlapping ends of the first length of rope packing;

such that when the ram is positioned as a pair of opposed rams in the extended position in the horizontal ram bore, the primary rope packing seals on opposing rams seal against each other on opposing front faces, against the tubular member if present, and against the ram bores so that the primary rope packing seals themselves seal the central bore.

28. The ram of claim 27, further comprising a secondary rope packing seal formed on the ram from a second length of rope packing of a rope packing material in a braided, twisted, woven or knitted form extending horizontally across the front face, and being spaced from the primary rope packing seal, the secondary rope packing seal being held in, so as to protrude radially outwardly from, a second groove formed in the ram.

29. The ram of claim 28, wherein the primary rope packing seal is pressed or threaded into the continuous first groove and the secondary rope packing seal is pressed or threaded into the second groove.

30. The ram of claim 29, wherein the second groove is a continuous second groove which extends across the front face of the ram and then generally rearwardly to meet the continuous first groove, and wherein the second length of rope packing for the second rope packing seal extends rearwardly within the continuous second groove such that the ends of the second length of rope packing meet the primary rope packing seal.

31. The ram of claim 29, wherein the second groove is a continuous second groove which extends across the front face of the ram, rearwardly and then either upwardly over the top portion of the ram, spaced from the primary rope packing, or downwardly over the bottom portion of the ram, spaced from the primary rope packing, and wherein the second length of rope packing for the secondary rope packing seal extends within the continuous second groove, the continuous second groove being adapted to accommodate the overlapping ends of the second length of rope packing.

32. The ram of claim 29, further comprising a circumferential seal formed on the rear portion of the ram rearwardly of the primary rope packing seal to seal the ram in the horizontal ram bore, wherein the circumferential seal is formed from a third length of rope packing of a rope packing material in a braided, twisted, woven or knitted form held in a circumferential groove formed in the ram, the circumferential groove being adapted to accommodate joined abutting ends or overlapping ends of the third length of rope packing.

33. The ram of claim 32, wherein either or both of the second groove and the circumferential groove is formed with a widened portion to accommodate overlapping ends of the second length of rope packing or overlapping ends of the third length of rope packing in side by side relationship, the widened portion being formed at a location on the outer surface of the ram such that the overlapping ends are oriented generally perpendicular to a longitudinal axis of movement of the ram in the horizontal ram bore.

34. The ram of claim 32, wherein the first groove, the second groove and the circumferential groove are generally dove-tail shaped in cross section to hold the rope packings.

35. The ram of claim 34, wherein:

the ram is formed as a blind ram such that the front face of opposing rams seal against each other in the extended position to seal the central bore; or the front face of the ram is formed with a radial or V-shaped vertical groove to accommodate the tubular member comprising a polish rod.

36. The ram of claim 35, wherein the ram is a steel bodied ram and is generally cylindrical.

37. The ram of claim 27, wherein the joined abutting ends of the first rope packing are oriented generally perpendicular to, or diagonally across, a longitudinal axis of movement of the ram in the horizontal ram bore and wherein the joined abutting ends of the first rope packing are located at the top portion or the bottom portion of the ram.

38. The ram of claim 27, wherein the continuous first groove forms a widened portion at a top portion of the ram such that the overlapping ends of the first rope packing are held side by side and are oriented generally perpendicular to a longitudinal axis of movement of the ram in the horizontal ram bore.

39. The ram of claim 27, wherein the rope packing material is graphite rope packing which is wire reinforced.

* * * * *